United States Patent [19]

Adams

[11] Patent Number: 4,690,272

[45] Date of Patent: Sep. 1, 1987

[54] CONTAINER DISPLAY

[75] Inventor: William E. Adams, Portersville, Pa.

[73] Assignee: Adams Mfg., Portersville, Pa.

[21] Appl. No.: 884,476

[22] Filed: Aug. 18, 1986

Related U.S. Application Data

[63] Continuation-in-part of Ser. No. 714,975, Mar. 22, 1985, abandoned.

[51] Int. Cl.[4] ..... B65D 51/00

[52] U.S. Cl. ..... 206/45.28; 206/508; 206/557; 229/16 D; 229/44 R; 217/58; 217/60 R; 217/61; 40/312; 40/313; 40/539

[58] Field of Search ..... 206/44 R, 45.28, 501, 206/508, 557; 217/58, 60 R, 60 B, 61; 40/124, 124.1, 124.4, 312, 313, 538, 539; 229/44 R, 45 R, 43, 1.5 C, 16 D; 211/71, 88, 75, 106; 248/312, 312.1

[56] References Cited

U.S. PATENT DOCUMENTS

| | | | |
|---|---|---|---|
| 747,997 | 12/1903 | Mitchell | 217/61 |
| 884,003 | 4/1908 | Barton | 206/45.28 |
| 928,281 | 7/1909 | Rosenberg | 217/61 |
| 977,278 | 11/1910 | Davidson | 40/313 |
| 1,077,027 | 10/1913 | Austin | 248/312.1 |
| 1,251,921 | 1/1918 | Rich | 229/44 R |
| 1,363,298 | 12/1920 | Yoemans | 206/45.28 |
| 1,644,539 | 10/1927 | Minto | 312/248 |
| 1,671,184 | 5/1928 | Foster et al. | 217/61 |
| 1,687,678 | 10/1928 | Mallory | 229/1.5 C |
| 1,798,333 | 3/1931 | Marlowe et al. | 229/16 D |
| 2,202,798 | 5/1940 | House | 248/312.1 |
| 2,553,527 | 5/1951 | Christian, Jr. et al. | 217/61 |
| 3,159,273 | 12/1964 | Schecterson et al. | 206/45.28 |
| 3,360,115 | 12/1967 | Joffe | 229/43 |
| 3,394,861 | 7/1968 | Traux | 229/43 |
| 3,398,877 | 8/1968 | Jacobson | 229/45 |
| 3,417,861 | 12/1968 | Levy | 206/45.28 |
| 3,502,294 | 3/1970 | Kalbow et al. | 211/88 |
| 3,516,597 | 6/1970 | Bigelow | 229/43 |
| 3,713,578 | 1/1973 | Johnson | 206/45.28 |
| 3,749,276 | 7/1973 | Davis | 229/43 |
| 3,809,305 | 5/1974 | Persson | 229/45 |
| 3,921,948 | 11/1975 | Long | 211/45 |
| 3,977,595 | 8/1976 | Hillenberg | 229/45 R |
| 4,206,854 | 6/1980 | Takami | 206/508 |
| 4,300,700 | 11/1981 | Chang | 229/43 |
| 4,326,640 | 4/1982 | Netzberg et al. | 206/501 |
| 4,350,263 | 9/1982 | Hoffman | 229/43 |
| 4,418,883 | 12/1983 | Cohen | 248/312.1 |

FOREIGN PATENT DOCUMENTS

| | | | |
|---|---|---|---|
| 288296 | 1/1953 | Switzerland | 229/1.5 C |
| 463373 | 11/1968 | Switzerland | 206/45.28 |

*Primary Examiner*—Stephen Marcus
*Assistant Examiner*—David T. Fidei
*Attorney, Agent, or Firm*—Buell, Ziesenheim, Beck & Alstadt

[57] ABSTRACT

A lightweight, inexpensive, attractive container suitable for shipping, storing and displaying goods is disclosed in which a cover made of card stock, heavy paper or lightweight cardboard is pivotally attached at one end to a dish-like container preferably made of polycarbonate or polyvinylchloride. The body of the cover may be raised and lowered to open and close the container. One or more strut members are movably attached to the cover and are positioned on the cover with at least one end adjacent to a shoulder on the upper part of the container wall. This arrangement provides increased strength. When the cover is raised, the struts are moved into engaging relationship with respect to a slot provided in a container wall to support the cover in a raised displaying orientation. The cover preferably has product information printed thereon regarding the container's content.

13 Claims, 7 Drawing Figures

CONTAINER DISPLAY

CROSS REFERENCE TO RELATED APPLICATION

This application is a continuation-in-part of copending application Serial No. 714,975, filed March 22, 1985, now abandoned.

BACKGROUND OF THE INVENTION

1. Field of the Invention

This invention relates generally to container displays and more specifically, to a lightweight container in which goods may be stored, shipped and displayed for use or sale.

2. Description of the Prior Art

Various types of store displays are known. Most displays, however, are designed and utilized solely as a display and are seldom, if ever, also used as enclosures to ship or to warehouse goods. Likewise, most shipping containers are designed and utilized solely to ship and store goods and are not utilized to display the goods.

Cigar boxes are illustrative of containers which are used for both shipping and displaying goods. Such boxes have a hinged top with printing on both sides. U.S. Pat. Nos. 747,997 to Mitchell, 884,003 to Barton, 977,278 to Davidson, 1,671,184 to Foster et al., and 2,553,527 to Christian et al. teach that rigid strut members can be attached to the top and one side of a box to hold the top in an upright, open position. In all of these references the entire box is shown to be made of the same material. Furthermore, the struts are used only to hold the top in an open position. They serve no function when the container is closed.

A similar container is shown in U.S. Pat. No. 1,363,298 to Yoemans. He discloses a display box which looks very much like a shoe box having a base and a cover. Yoemans places within the box a display card having a strut positioned within a sleeve at the center of the display card. When the cover is removed from the box the display sheet is moved to an upright position and the strut is extended to hold the display sheet in that position. Then printed matter on the front of the card can be seen. Yoemans states that the card should be folded down and a cover placed onto the box in the usual way when the box is transported or stored. Thus, the teaching of Yoemans is that card stock is not a suitable material for making covers for boxes which are to be used for shipment and storage. Indeed, the field has generally believed that card stock is not strong enough to serve as a cover for containers that are used to transport and store goods.

If the limited strength of card stock could be improved, it would be an excellent cover for a container because it is inexpensive and can be easily printed. Until the present invention the art has not developed a container display which employs a lightweight top made of cardboard or card stock and yet is strong enough to allow shipment of goods in the container and stacking of the container without crushing the top.

SUMMARY OF THE INVENTION

The present invention provides a sturdy, lightweight, attractive container having a cover made from lightweight cardboard or card stock which may be lifted and supported in an upright position to serve as a display. Struts are provided on the cover which can be used to hold the cover in an open, upright position. When the cover is closed the struts impart additional strength to the cover making the container suitable for stacking and transport without crushing.

Preferably the container includes a bottom portion and an upwardly depending side wall portion and is formed into a dish-like structure having an open top and a shoulder or rim at the top of its side walls. The wall portion is provided with a slot in at least one location. A cover sized to close the open top is preferably pivotally connected at one end to the wall portion in a manner allowing a free opposite end thereof to be raised and lowered to open and close the container. Alternatively, the cover may be completely removable. At least one strut member having one end adapted to be received by the slot and an opposite end adapted to be received by strut receiving means is provided. The struts are sized and positioned to have opposite ends overlapping the shoulder when the top is closed. Strut receiving means are provided on the cover for movably attaching the strut to the cover or for receiving a strut which is extended from the slot in the container wall. The strut is moved to engage both the slot and the strut receiving means when the cover is raised to support the cover in a raised displaying orientation.

Preferably, the receiving means is a sleeve formed from a portion of the cover through which the strut member may slide longitudinally. The strut may be in an engaging position or in a non-engaging position with respect to the slot. Alternatively, the strut receiving means may be an arc-shaped slot into which a pivoting strut may move. An arc-shaped slot is appropriate where one end of the strut member is pivotally attached to the cover portion in a manner so that an opposite end thereof may move through an arc between an engaging and non-engaging position with respect to the slot.

Preferably the container is formed of plastic, particularly clear polycarbonate or clear polyvinylchloride, and the wall portion includes a recess to receive one end of the cover which is made from card stock, heavy paper (at least 90 pound weight), or lightweight cardboard. The cover is preferably attached to the wall portions by staples. The side of the cover which faces the bottom portion of the container when the cover is closed preferably includes product information about goods which may be shipped, stored and displayed in the container.

If desired, wire holding means formed in the shape of a loop may be utilized to secure the container display to a peg board or the like. In such cases, a top portion of the container is preferably provided with an outwardly extending rim portion sized to be received by the wire loop.

It is an object of the present invention to provide a container and cover therefor which can be utilized both as an enclosure to ship and store goods and as a display for such goods.

It is another object of the invention to provide such a container display which is simple and attractive in its design, lightweight, sturdy and relatively inexpensive to manufacture.

It is yet another object of the invention to provide a container having slots therein into which struts may be inserted to support the container's cover in an upright displaying orientation.

It is still another object of the invention to provide displays that can nest inside of each other to minimize the space required to store or ship empty containers.

These and other objects and features of the present invention will be more fully understood upon reference to the accompanying drawings illustrating certain presently preferred embodiments of the invention.

DESCRIPTION OF THE PREFERRED EMBODIMENTS

Figure 1:
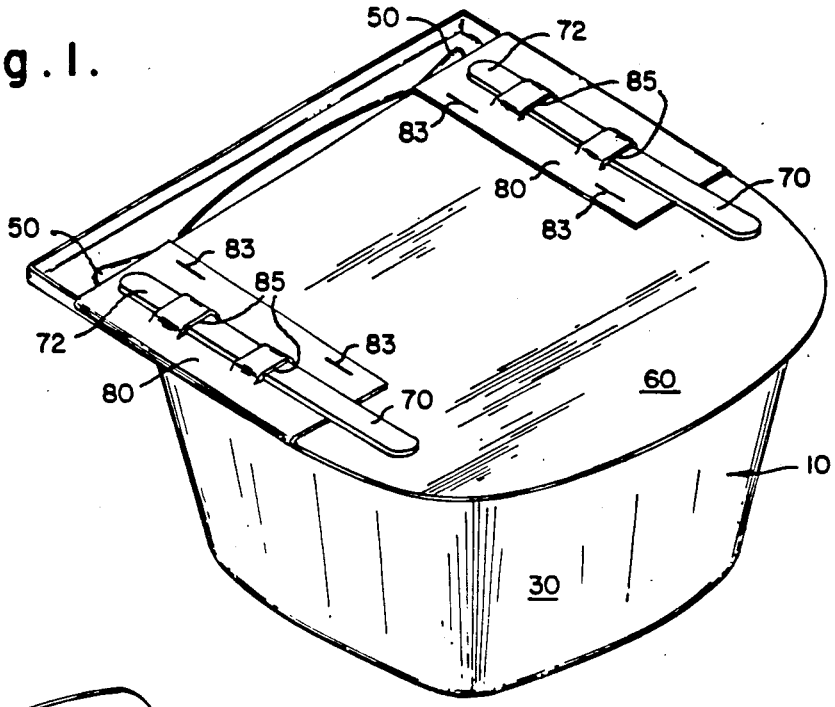
FIG. 1 is a front perspective view of one form of the container display of the present invention in a closed position.

Referring to FIGS. 1 through 4, the container display of the present invention includes base portion 20 and an upwardly depending wall portion 30 which together form a dish-like bottom structure 10 having an open top. Wall portion 30 is formed to have slot means 50 provided in at least one location. A shoulder or rim portion 34 surrounds the open top. I prefer to extend the rim 34 beyond the wall portion 30 to permit the container to be held by a looped wire holding means. The loop is sized so that the rim 34 of the container rests on and is supported by the loop. The base 20, wall portion 30 and rim portion 34 are preferably vacuum formed from a transparent plastic material such as polycarbonate or polyvinylchloride. Wall portion 30 also preferably includes a recess 32 to receive end 62 of cover means 60. I prefer to make the bottom structure 10 with sloping walls 30 and a bottom 20 which is smaller than the open top. This permits empty containers without covers to be nested for storage.

Cover means 60 is provided and is sized to close the open bottom structure 10. It is preferably pivotally connected at one end 62 to the wall portion 30 in a manner allowing a body portion 66 of cover 60 to be raised and lowered to open and close the container. Staples 63 can be used to attach end 62 to the wall portion 30 of the bottom 10. Cover 60 may then be folded along fold line 65 to allow the body portion 66 of cover 60 to pivot upwardly and downwardly with respect to the container bottom 10. When the container is used to ship goods body portion 66 may be secured to rim 34 by tape or an adhesive. Alternatively, the cover may be completely removable and, in such case, would not pivot on fold line 65.

Figure 7:
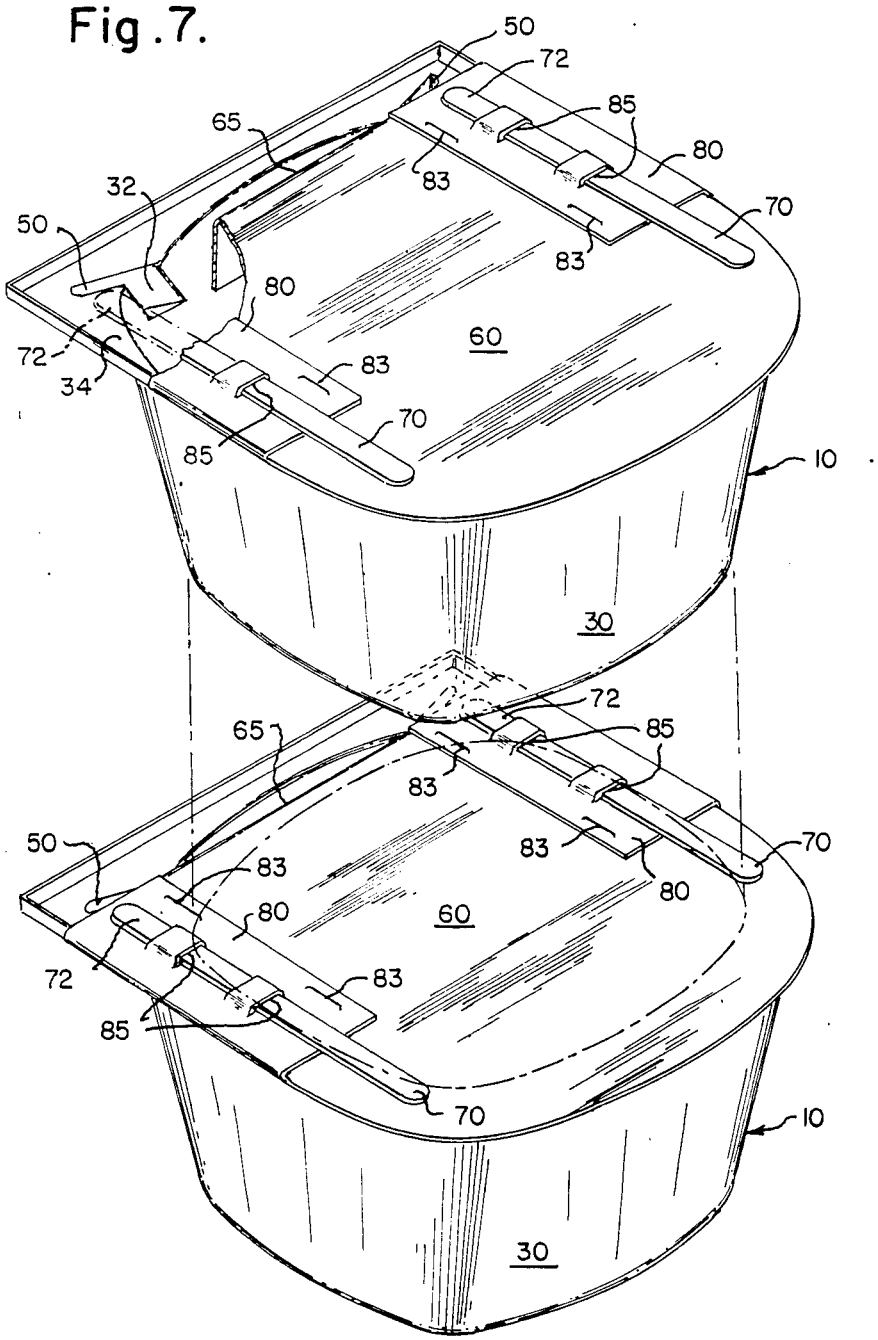
FIG. 7 is a perspective view of two of the containers of FIG. 1 showing how these containers are stacked on top of one another.

Support strut members 70 are movably attached to cover 60 by strut receiving means 80. One end 72 of the strut member 70 is sized to be received by slot means 50 and the opposite end is sized to be received by strut receiving means 80. Strut members 70 are preferably elongated wooden members although any rigid material may be used. The struts are positioned adjacent the rim when the cover is in a closed position so that at least one end of the strut 70 is above a portion of the rim 34. In FIG. 7 a portion of the cover of the top container is cut away to show the relative positions of the strut 70 and the rim. In addition to having one end of the strut extend over the rim 34, I prefer to use two struts which are placed near the edge of the cover 60 which is resting on rim 34. This placement lessens the possibility that the cover will bend when weight is placed on the struts. That possibility would increase if the struts were in the center of the cover and both ends of the strut did not extend over the rim 34. The struts should be arranged so that when one container is placed on a second container the top container will rest on the struts 70, not on the cover 60, as shown by chain line in FIG. 7. I have found that two struts positioned generally parallel to one another as shown in FIG. 1, work very well. By securing the rigid strut members to cover 60, as shown in FIG. 1, the rigidity of the cover is increased. Consequently, cover 60 can be made of inexpensive, card stock, lightweight cardboard or even 90 pound paper that would otherwise not be suitable for a shipping container. Strut receiving means 80 are formed by folding portions of cover 60 inwardly and stapling the edges thereof with staples 83. Slits 85 are provided in the inwardly folded portion of the cover to allow for the insertion and longitudinal movement of strut 70. Thus, strut receiving means 80 function like a sleeve through which the strut 70 moves. The combination of lightweight cardboard cover and attached struts create a sturdy, inexpensive, lightweight container that is easily stacked on other similar containers.

Cover 60 preferably is formed from a single sheet of card stock. I prefer to use card stock, heavy paper (90 pound or heavier), or lightweight cardboard because it is inexpensive, readily available and can easily be printed with graphics or product information. If paper is used for the cover, it should be of sufficient weight so that it will not easily bend or flop over when in an upright position. Plastics and corrugated cardboard of the type commonly used in shipping boxes because of their strength are unnecessary and less desirable because they cost more and cannot be printed as easily and as cheaply.

Figure 2:
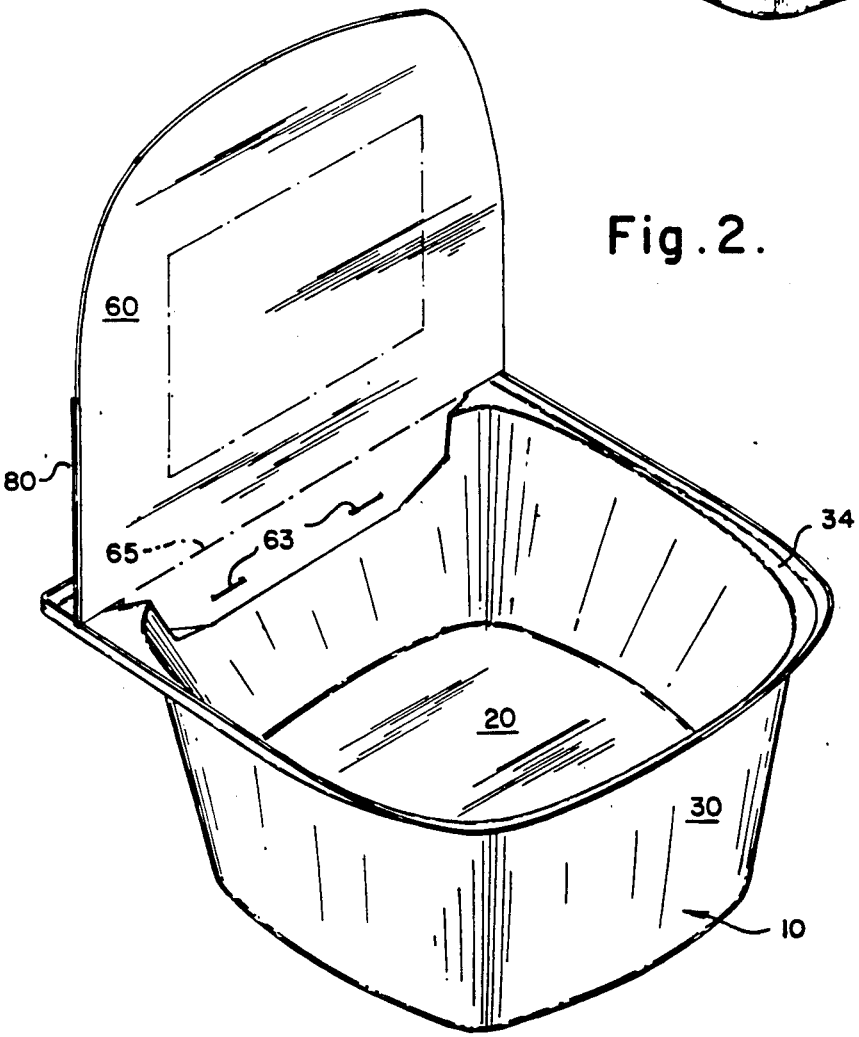
FIG. 2 is a front perspective view of the container display shown in FIG. 1 in an open position.
Figure 4:
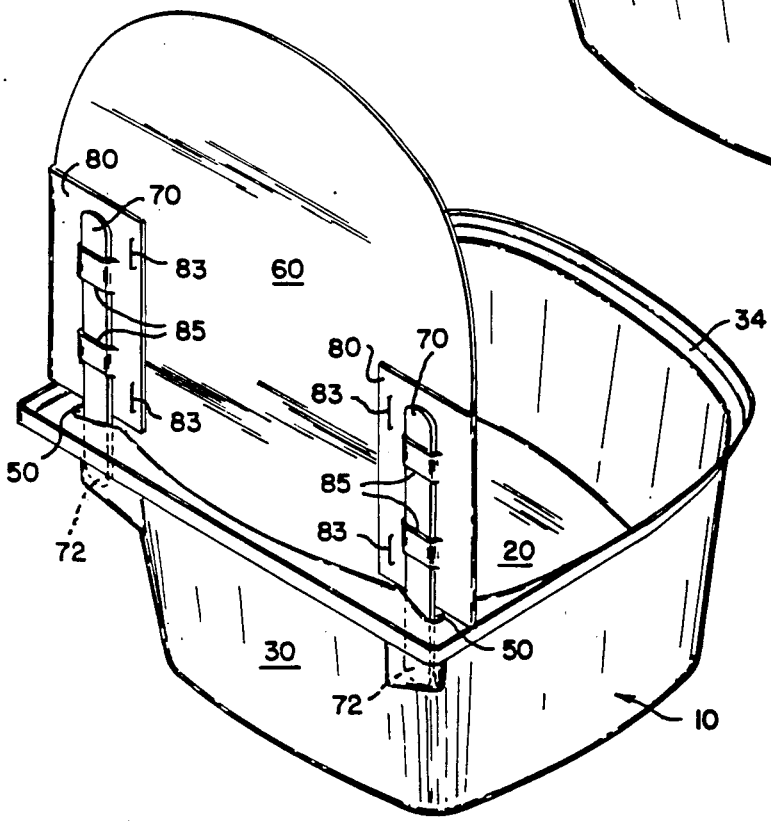
FIG. 4 is a rear perspective view of the container display shown in FIGS. 1 thru 3.

When cover 60 is in its raised position as shown in FIGS. 2 and 4, strut members 70 are moved downwardly into an engaging relationship with slots 50 in wall portion 30 of container 10. Strut members 70, strut receiving means 80 and slot means 50 all act to support the cover 60 in its raised, displaying orientation.

Figure 3:
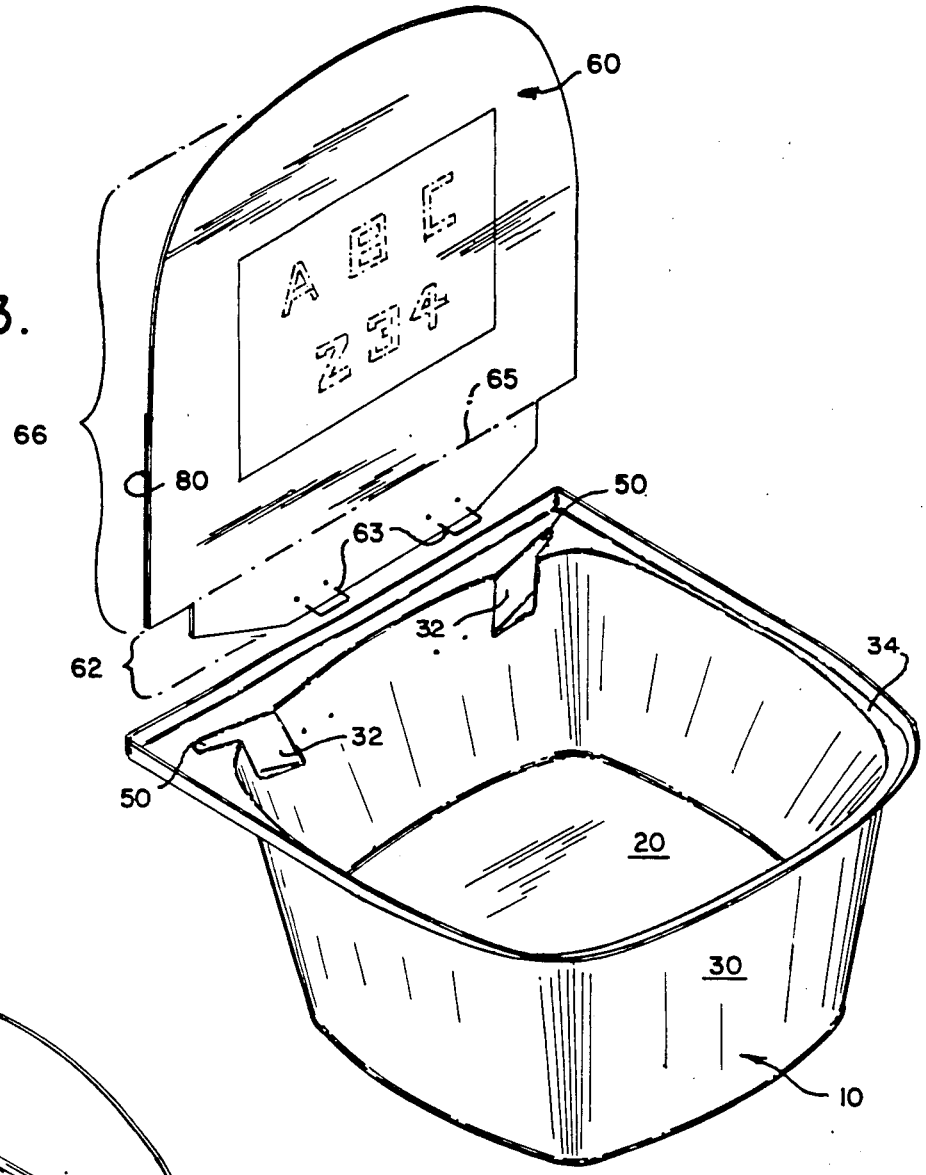
FIG. 3 is an exploded perspective view of the container display shown in FIG. 2.

The face of cover 60, which faces the bottom portion 20 of container 10 when cover 60 is in its closed position, is preferably provided with textual or graphic product information thereon. An example of such product information is shown in FIG. 3 as "ABC 234". Such information may also be provided on the opposite face of cover 60 if desired.

Figure 5:
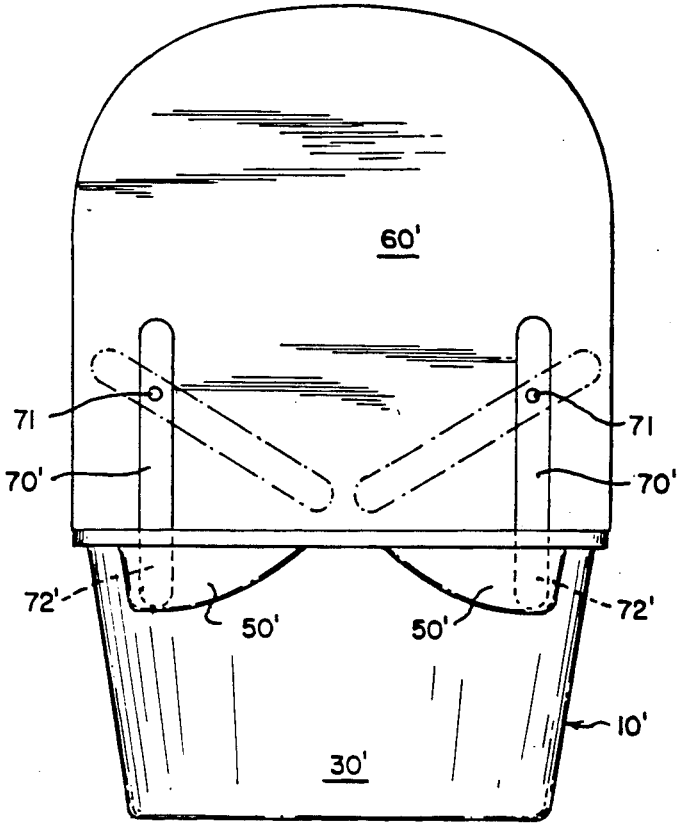
FIG. 5 is a rear elevational view of another embodiment of the present invention in an open position wherein the struts are pivotably attached to the cover.

FIG. 5 shows a second embodiment of the present invention. In this embodiment, one end of strut members 70' or a central portion thereof are pivotally attached to cover 60' at 71 in a manner allowing opposite free end 72' thereof to swing between an engaging position (solid line) and a non-engaging position (chain line) with respect to slot means 50'. The pivotal connection at 71 in this embodiment of the invention replaces the sleeve 80 in the embodiment of FIGS. 1 thru 4. Nevertheless, in this embodiment at least one end of each strut will be above the rim when the cover is closed.

Figure 6:
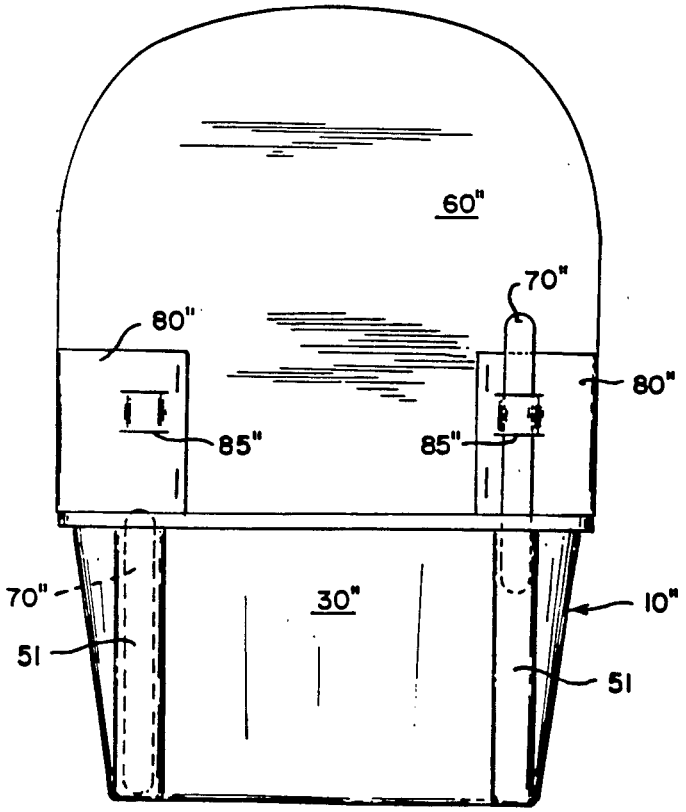
FIG. 6 is a rear elevational view of yet another embodiment of the present invention in an open position wherein the struts can be fully inserted into and stored in the bottom portion of the container.

FIG. 6 shows yet another embodiment of the present invention in which the struts 70″ can be stored in slots 51 provided in wall portion 30″ of bottom 10″ if the cover is removed. Slots 51 preferably have a depth approximately equal to the length of struts 70″ so the entire strut may be stored therein. When cover 60″ is raised, struts 70″ may be moved upwardly from their stored position (dash line) into an engaging relationship with strut receiving means 80″ and slits 85″ (solid line). When the cover 60″ is closed the struts 70″ should be positioned on the cover with opposite ends overlap the internal rim the embodiments of FIG. 7. Otherwise, the container will not be suitable for stacking other containers on top of it.

From the foregoing description, it can be seen that the present invention provides a unique, inexpensive and effective container which may be utilized both as an enclosure to ship and store goods and as a display for such goods.

Whereas particular embodiments of the invention have been described above for purposes of illustration, it will be appreciated by those skilled in the art that numerous variations of the details may be made without departing from the invention as described in the appended claims.

I claim:

1. A container for shipping, storing and displaying goods comprising:

(a) a bottom including a base portion upwardly depending wall portion forming a dish-like structure having an open top, the wall portion having at least one slot sized and positioned to receive and support a strut, and a rim on the upper portion of the wall portion.

(b) a lightweight cover made from a material selected from the group comprising lightweight cardboard, card stock and paper which is at least 90 pound weight, divided into a first portion and a second portion by a fold line across the cover, the first portion sized to cover the open top and to extend over at least part of the rim, and the second portion sized for attachment to the wall portion of the base, the second portion of which is attached to the wall portion of the base in a manner allowing the cover to be folded along the fold line to a closed position closing the container with the cover resting on at least part of the rim, and raised to an open portion in which the first portion of the cover and the second portion of the cover are in the same plane;

(c) at least one rigid support strut having one end sized to be received by the slot, said strut movably attached to the cover in a manner so that the strut is (i) substantially perpendicular to the fold line, (ii) able to be moved into engagement with the slot and the first portion of the cover when the cover is in an open position (iii) and sized and positioned to be within the first portion of the cover and have opposite ends overlap the rim when the cover is closed and to provide support to the first portion of the cover.

2. A container display according to claim 1 wherein the strut receiving means is a sleeve attached to the cover in a manner allowing the strut member to slide longitudinally in the sleeve between engaging and non-engaging positions with respect to the slot.

3. A container display according to claim 2 wherein the cover is provided with a portion is folded inwardly to form the sleeve and the folded portion is thereafter secured to the cover.

4. A container display according to claim 1 wherein the strut is pivotally attached to the cover so that one end of the strut may swing through an arc between engaging and non-engaging positions with respect to the slot.

5. A container display according to claim 1 wherein the cover is pivotally connected at one end thereof to the wall portion in a manner allowing a free opposite end thereof to be raised and lowered to an open position and a closed position.

6. A container display according to claim 5, wherein the cover means further comprises a body portion and an attaching portion formed from a single sheet of cardboard and folded along a line where the body and attaching portions meet, and wherein the attaching portion is secured to the wall portion.

7. A container display according to claim 6 wherein the wall portion has a recess therein sized to receive the cover means.

8. A container display according to claim 1 wherein the container means is formed of plastic.

9. A container display according to claim 1 wherein the cover means is attached to the wall portion by staples.

10. A container display according to claim 1 wherein the cover means has product information printed thereon.

11. A container display according to claim 1 including a plurality of strut members and strut receiving means.

12. A container display according to claim 1 wherein the strut member is an elongated wooden member.

13. A container display according to claim 1 wherein the slot has a depth at least as great as the length of the strut members and the strut members can be movably supported and stored within the wall portion by the slot.

* * * * *

UNITED STATES PATENT AND TRADEMARK OFFICE

CERTIFICATE OF CORRECTION

PATENT NO. : 4,690,272

DATED : September 1, 1987

INVENTOR(S) : WILLIAM E. ADAMS

It is certified that error appears in the above-identified patent and that said Letters Patent is hereby corrected as shown below: On the title page At [56] References Cited, the Long reference 3,921,948 should read --211/75-- instead of "211/45".

Column 5, line 12, after "rim" insert --as shown in-- and change "embodiments" to --embodiment--.

Column 5, line 29, Claim 1, after "portion" insert --and--.

Column 6, line 14, Claim 3, after "portion" insert --which--.

Signed and Sealed this

Twenty-sixth Day of April, 1988

*Attest:*

DONALD J. QUIGG

*Attesting Officer*

*Commissioner of Patents and Trademarks*